US005078837A

United States Patent [19]

Descamp et al.

[11] Patent Number: 5,078,837

[45] Date of Patent: Jan. 7, 1992

[54] PROCESS FOR PRODUCING WEAR RESISTANT COATINGS FOR ENGINE COMPONENTS

[75] Inventors: Martine Descamp, Villejuif; Yves C. Louis, Orsay; Ruimi, Paris, all of France

[73] Assignee: Societe Nationale D'Etude et de Construction de Moteurs D'Aviation "S.N.E.C.M.A.", Paris, France

[21] Appl. No.: 673,459

[22] Filed: Mar. 22, 1991

Related U.S. Application Data

[62] Division of Ser. No. 434,019, Nov. 9, 1989.

[30] Foreign Application Priority Data

Nov. 9, 1988 [FR] France ..... 88 14607

[51] Int. Cl.[5] ..... C25D 15/00

[52] U.S. Cl. ..... 205/181; 205/183; 205/195; 205/224; 205/273; 205/280

[58] Field of Search ..... 204/16, 37.1, 38.1, 204/38.4, 38.5, 38.6, 42, 181.1, 181.4

[56] References Cited

U.S. PATENT DOCUMENTS

| | | | |
|---|---|---|---|
| 4,124,737 | 11/1978 | Wolfla et al. | 428/640 |
| 4,275,124 | 6/1981 | McComas et al. | 428/678 |
| 4,401,724 | 8/1983 | Moskowitz et al. | 428/678 |
| 4,627,896 | 12/1986 | Nazmy et al. | 204/37.1 |
| 4,741,975 | 5/1988 | Mair et al. | 428/627 |
| 4,810,334 | 3/1989 | Huney et al. | 204/16 |
| 4,855,188 | 8/1989 | Garg et al. | 428/627 |
| 4,873,152 | 10/1989 | Garg et al. | 428/627 |
| 4,886,583 | 12/1989 | Martinou et al. | 204/16 |
| 4,943,487 | 7/1990 | Benn et al. | 428/678 |

*Primary Examiner*—John Niebling
*Assistant Examiner*—William T. Leader
*Attorney, Agent, or Firm*—Oblon, Spivak, McClelland, Maier & Neustadt

[57] ABSTRACT

Engine components of steel or superalloy subject to wear from alternating friction at medium temperatures in the region of 700° C. are provided with a protective wear-resistant coating by a) electrophoretic deposition of a metal-ceramic structure comprising a mixture of from 85% to 50% of metallic powder and from 15% to 59% of ceramic powder, the metallic powder being a cobalt-based superalloy of type KC 25 NW or of M Cr Al Y wherein M represents at least one metal chosen from the group consisting of Ni, Co and Fe with the possible addition of Ta, and the ceramic powder being an oxide such as $Al_2O_3$ or $Cr_2O_3$, a carbide such as SiC or $Cr_3C_2$, a nitride such as BN or TiN, or a boride such as $TiB_2$;

b) electrolytic pre-nickeling said deposit in an electrolysis bath at a pH between 6 and 8, and c) electrolytic nickeling said pre-nickeled deposit in an acid bath of sulphamate type.

A further step of stress-relieving the nickeled deposit may be carried out at a temperature below 700° C.

11 Claims, 13 Drawing Sheets

G x 100

G x 500

G x 500

G x 100

G x 500

G x 500

G x 100 e≈60 to 70 μm

G x 200

MCrAlY

BN

BN

Ni

G x 500

G x 100

G x 500

G x 1000

G x 100

G x 500

G x 500

G x 25

G x 200

G x 1000

G x 25

G x 200

G x 1000

G x 25

G x 200

G x 1000

G x 25

G x 200

G x 1000

PROCESS FOR PRODUCING WEAR RESISTANT COATINGS FOR ENGINE COMPONENTS

This is a division of application Ser. No. 434,019, filed on Nov. 9, 1989.

BACKGROUND OF THE INVENTION

1. Field of the invention

The present invention relates to engine components of steel or superalloy comprising a coating for preventing wear when subjected to alternating friction at medium temperature, i.e. in the vicinity of 700° C., and also to a process for obtaining such coatings.

In turboshaft engines, for example, particularly those intended for aircraft, several parts subjected to temperatures from 400° C. to 800° C. undergo alternating frictions against which they must be protected. Some examples of where such frictions occur are as follows:

the centering of the combustion chamber inlet diffuser on the preceding compressor stage;

the support of an upstream inner platform of the high pressure turbine guide on the downstream flange of the combustion chamber;

the positioning of the outer platform of the high pressure turbine guide on the front and rear flanges of the high pressure turbine casing;

the fixing flange of turbine sectors on the high pressure turbine casing;

the centering of the exhaust cone on the turbine outlet casing.

2. Summary of the Prior Art

An attempt has been made to form a coating at these various places which would compensate for wear and provide a hard wear-resistant layer. For this purpose, the components at these places were subjected to a localized electrolytic deposition of cobalt with a chromium oxide $Cr_2O_3$ phase in the cobalt bath. It has been observed, however, that although this type of coating is effective in the first two examples mentioned above, it is not at all so in the last three cases where wear and flaking, and even breaking away, of the coating has occurred.

It has been possible to correlate these observations with the temperatures experienced at the different areas, and it has been determined that electrolytic depositions of cobalt with a dispersed phase of chromium oxide only behave satisfactorily below a temperature of 700° C. on a continuous basis, beyond which, flaking occurs.

SUMMARY OF THE INVENTION

The aim of the invention is to solve the problem of providing a wear-resistant coating which remains effective beyond 700° C. on a continuous basis.

To achieve this, the invention proposes to effect a metallic deposition of M Cr Al Y type, wherein M is selected from the group comprising Ni, Co, Fe and mixtures thereof with the possible addition of Ta, dispersed with ceramic particles chosen from the group comprising oxides, carbides, nitrides and borides. This type of coating may be obtained by electrophoretic deposition but it is necessary, in order to make it adherent to the substrate, to increase the proportion of nickel in the deposit. The invention therefore further proposes to consolidate the deposition by adding nickel electrolytically, and then to perform a heat treatment at a relatively low temperature, so as to stress-relieve the coating.

The most commonly used electrolytic nickel-plating processes are generally carried out in acid baths containing nickel sulphamate. However, it has been observed, when performing electrolytic nickel-plating onto a composite electrophoretic deposition of M Cr Al Y metal and ceramic in a sulphamate bath, that the electrophoretic layer was systematically destroyed. The cause of this seems to originate from the acidity of the bath (pH below 4) which produces a chemical reaction of the acid solution with the powder deposit.

On the other hand, if it is desired to use a nickel-plating bath having a pH close to 7, another problem has to be faced, which is the poor cathodic yield due essentially to the instability of the bath resulting from the precipitation, at pH=5.5, of nickel salts in the form of hydroxide Ni $(OH)_2$.

Another difficulty with such metal-ceramic deposits consolidated by nickel-plating comes from the fact that, to obtain an adequately resistant layer, one is tempted to carry out the electrophoretic powder deposition to a considerable thickness. However, whatever the nature may be of the nickel bath used, very thick depositions (above 40 microns) have a tendency to react badly to nickeling. On the other hand, it has been observed that it is easier to nickel electrophoretic deposits of small thickness, the intensity and the voltage remaining constant throughout the operation.

In effect, electrolytic nickel-plating is performed at a constant current density, but the mechanical brittleness of thick layers of the initial electrophoretic deposit and their electrical resistance result in the occurrence of breakdown phenomena (mechanical and electrical), and therefore short-circuits, if one chooses to operate with too high a current density.

The invention, which resides in providing an electrophoretic metal-ceramic deposition consolidated by electrolytic nickeling, is thus made possible by the judicious selection of the parameters of the successive operations of electrophoresis and electrolytic nickeling, and also by carrying out, between the electrophoresis and electrolytic nickeling in an acid medium, an electrolytic prenickeling in a medium close to neutrality, so as to create in the electrophoretic deposit a nickel film which commences consolidation of the deposit without damaging it, and also acts as a bonding base for the nickel subsequently deposited.

According to the invention, therefore, there is provided an engine component of steel or superalloy having a protective coating for providing wear-resistance against alternating friction at medium temperatures, said protective coating comprising a metal-ceramic structure formed from a cobalt based superalloy of KC25NW type or a mixture of metallic powders of M Cr Al Y type wherein M represents at least one metal selected from the group consisting of Ni, Co, and Fe, with the possible addition of Ta, and from ceramic powders selected from the group consisting of oxides (preferably $Al_2O_3$ and $Cr_2O_3$), carbides (preferably SiC and $Cr_3C_2$), nitrides (preferably BN and TiN), and borides (preferably $TiB_2$), said metal-ceramic structure being formed by electrophoretic deposition and being consolidated and bound to the component by electrolytic nickeling and stress-relieving heat treatment at a temperature below 700° C.

Further according to the invention there is provided a process for forming a protective coating on an engine component of steel or superalloy, particularly a nickel-based alloy, for providing wear resistance against alternating friction in the dry state at medium temperatures the process comprising the steps of:

a) forming a deposit on said component by electrophoresis, said deposit having a metal-ceramic structure comprising a mixture of from 85% to 50% by mass of metallic powder and from 15% to 50% by mass of ceramic powder, in which said metallic powder is a cobalt-based superalloy of KC25NW type or is of M Cr Al Y wherein M represents at least one metal selected from the group consisting of Ni, Co, and Fe with the possible addition of Ta, and said ceramic powder is selected from the group consisting of carbides, oxides, nitrides and borides;

b) subjecting said deposit to electrolytic prenickeling in an electrolysis bath at a pH of from 6 to 8; and c) after said prenickeling, subjecting said deposit to electrolytic nickeling in an acid bath of sulphamate type.

Preferably the duration of the electrophoresis step a) is between 5 and 60 seconds and said deposit has a thickness of from 10 to 40 microns depending on the grain size of the powders used.

Preferably, the electrolytic prenickeling step b) is carried out in an electrolysis bath containing ammonium lactate and having its pH kept between 6 and 8 by the addition of soda.

In order to produce a protective coating having a substantial thickness, for example 100 microns, a series of relatively small thickness deposits are formed one on top of another by repeating the sequence of steps (a),(b) and (c), either with a stress-relieving treatment after each nickeling step or with only one stress-relieving heat treatment after the last nickeling step, until the desired thickness has been reached. In contrast, with the knowledge previously available to the specialist the tendency would have been towards carrying out the electrophoretic deposition to produce the required thickness in a single operation, followed by the operations of pre-nickeling, nickeling and stress-relieving, which would have resulted in the nickeling problems mentioned earlier.

The process in accordance with the invention may also include a pre-nickeling step and a nickeling step before subjecting the component to the electrophoresis step to form the metal-ceramic deposit. The pre-nickeling step may be carried out for a period of from 5 to 6 minutes at a current density of from 4 to 5 A/dm$^2$. The nickeling may be carried out for a period of from 20 to 40 minutes at a current density of from 3 to 5 A/dm$^2$.

BRIEF DESCRIPTION OF THE DRAWINGS

FIG. 27 is a comparative diagram comparing the performance of coatings produced in accordance with the invention with that of three other coatings of known type in terms of the volume worn on running-in.

DESCRIPTION OF THE PREFERRED EMBODIMENTS

Figure 1:
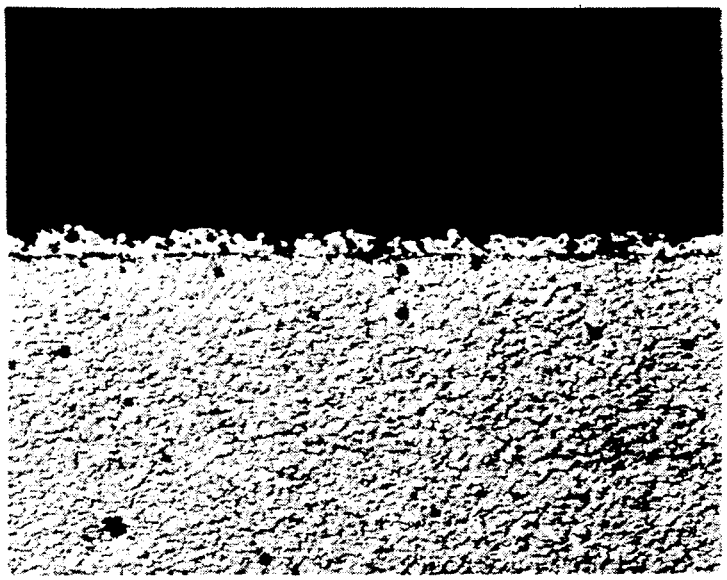
FIGS. 1 to 3 are photomicrographs at magnifications of X100, X500, and X500 respectively of a section through a first example (sample 325) of a metal-ceramic coating produced in accordance with the invention wherein the coating comprises a mixture of Co Ni Cr Al Y Ta+20% $Al_2O_3$ of grain size less than 25 microns the photomicrographs being taken after micrographic attack in a bath containing HF 15%, $HNO_3$ 15%, and $H_2O$ 70%.

Numerous tests under different operational conditions were carried out following a common general procedure. Test pieces consisting of 1 dm$^2$ plates of alloy Z12 C13—AFNOR standard (trade name: AISI 410) having the following composition by weight: 0.12% C, 13% Cr, and Fe the remainder were used as substrates for protective coatings produced in accordance with the invention.

After preparation in a known manner involving cleaning and polishing, the test pieces were mounted in the cathodic position in an apparatus of known type permitting electrophoretic deposition. In all the cases tested, the electrophoresis bath used comprised a base of isopropanol/nitromethane, with a soluble metallic or organometallic salt as electrolyte in an amount less than 0.1 grams per liter.

The metal-ceramic mixture to be deposited consisted, in all of the examples, of 80% by weight of metallic powder (either of cobalt based superalloy or of M-Cr Al Y type, as defined earlier) and 20% by weight of ceramic powder.

In the case of the example using cobalt-based superalloy (sample No. 469), KC25NW (AFNOR standard) was used, this being obtained under the trade name HS 31 and having a composition, by weight, of Cr 24 to 26%; Ni 10 to 12%; W 7 to 9%; and Co the remainder.

In the case of the examples using M-Cr Al Y powder (samples Nos. 281,285,286,325,328,331), the powder used was that obtained under the name AMDRY 67 having a composition, by weight, of Cr 23 to 25%; Ni 8.5 to 11%; Al 6 to 8%; Ta 4 to 6%; Y 0.4 to 0.8%; and Co the remainder.

After mixing in the proportions mentioned above, in one example the metal-ceramic mixture had the composition, by weight,: Co 35.69%; ceramic 20%; Cr 19.37%; Ni 8.65%; Al 8.06%; Ta 7.84%; Y 0.39%.

Various concentrations of metal-ceramic mix between 40 g/l and 100 g/l were tested, and good results were obtained for a 60 g/l concentration.

The electrophoretic deposition was carried out with an electric potential U=500 V, and for a period between 5 and 60 seconds with magnetic stirring. The electric field may be from 100 to 500 V/cm.

After the electrophoretic deposition, the test pieces were placed in an electrolysis tank where they were subjected to pre-nickeling in a near neutral bath comprising:

| | |
|---|---|
| $NiSO_4$ | 70 g/l |
| $H_3BO_3$ | 15 g/l |
| $NH_4Cl$ | 15 g/l |
| Ammonium lactate | 10 g/l (8.5 ml/1). |

The pre-nickeling was conducted under the following conditions:

pH maintained between 6.8 and 7 by the addition of NaOH;

current density between 0.1 and 0.5 A/dm$^2$;

temperature between 20° C. and 35° C.;

anodes of pure silver;

duration from 10 to 30 minutes.

The test pieces were then subjected to nickeling in an acidic bath (pH close to 4) composed of 75 g/l of Ni metal in the form of Ni sulphamate, 18 g/l nickel chloride $NiCl_2$, $6H_2O$, 35 g/l $H_3BO_3$, and a wetting agent, the nickeling being carried out under the following conditions:

current density between 0.5 and 1/Adm$^2$;

duration from 10 to 60 min;

temperature between 20° C. and 50° C.

The test pieces were then subjected to a nickel stress-relieving treatment at 600° C. under vacuum for 4 hours. Within this general procedure, the following parameters were subjected to variations:

the nature of the ceramic powder; SiC, $Cr_3C_2$, $Al_2O_3$, BN, TiN;

the gain size of the powders: a first series of tests were conducted with powders of diameter ranging from 40 to 50 microns, and a second series of tests were conducted with powders of a diameter less than 25 microns.

the temperature during the pre-nickeling and nickeling steps;

the current density and duration for each of the pre-nickeling and nickeling operations.

Table 1 (at the end of the description) summarizes the various operational conditions tested during the pre-nickeling and nickeling operations. In each case, two or three layers (each comprising one electrophoretic deposition, pre-nickeling in a near neutral bath and nickeling in an acidic bath) were deposited in forming the coating.

First Example: (Samples 325 and 326)

An electrophoretic deposition of a powder mixture of Co Ni Cr Al Y Ta and 20% by weight of alumina $Al_2O_3$, the metallic and ceramic powders each having a grain size below 25 microns, was formed on a substrate of Z 12 C 13 in the manner described above.

Pre-nickeling in a near neutral bath containing ammonium lactate was then carried out at 30° C. for 20 mins at a current density of 0.1 A/dm$^2$, and in order to obtain a substantial nickel percentage per layer this was followed by nickeling in a sulphamate bath for a period of 60 mins.

The nickeling was divided into two stages having different parameters (temperature and current density). In the first stage (C1) the temperature was 30° C. and the current density 0.5 A/dm$^2$, and in the second stage (C2) the temperature of the bath was raised to 50° C. and the current density to 1 A/dm$^2$. The first stage of nickeling may be carried out at a temperature of from 25° C. to 55° C. for a period of about 30 minutes. The second stage may be carried out at a temperature of from 45° C. to 55° C. for a period of from 30 to 60 minutes.

For sample 325, two consecutive layers each comprising a metal-ceramic electrophoretic deposition, a pre-nickeling and a nickeling as described above were deposited, followed by a nickel stress-relieving treatment at 600° C. under vacuum for 4 hours.

Under the conditions described above it was found, after analysis, (see Table 1) that the final composition of the coating was an alloy comprising about 50% of metal-ceramic powder and 50% electrolytic nickel.

Figure 2:
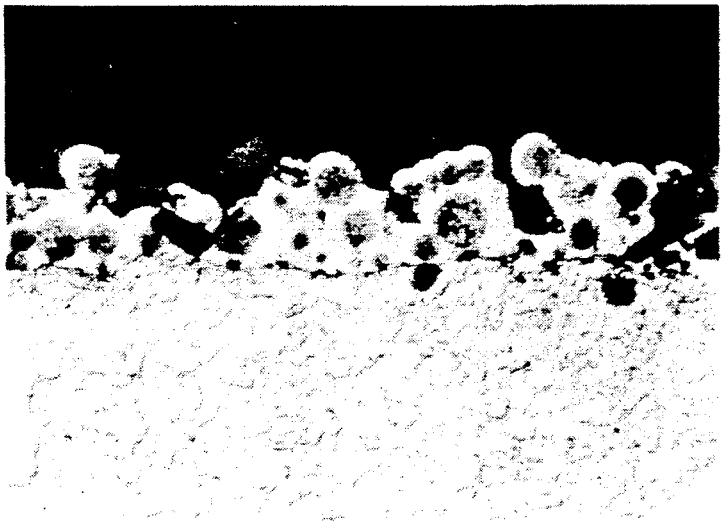
Figure 3:
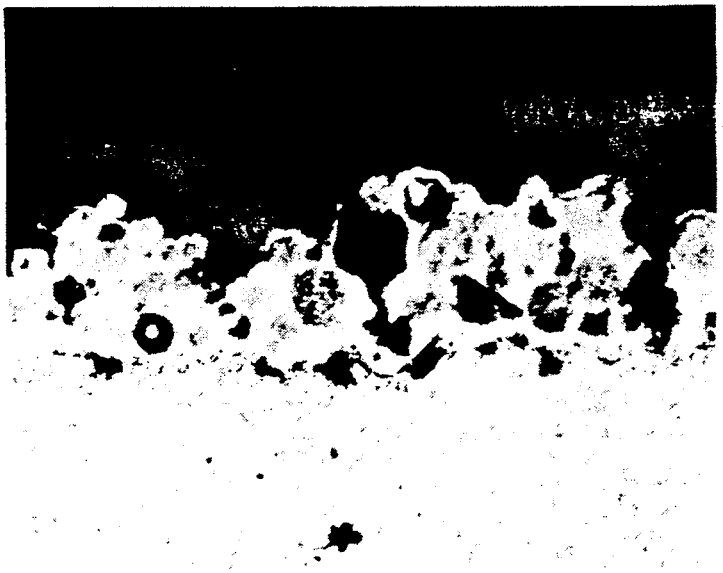

FIG. 1 shows that the coating is even and that its thickness ranges from 35 to 50 microns. The photograph of FIG. 2, at greater magnification, was taken in an area of 35 micron average thickness and shows a good distribution of the particles of alumina in the electrolytic nickel. The photograph of FIG. 3, at the same magnification as FIG. 2, was taken in an area of 50 micron thickness and also evidences the satisfactory distribution of the metallic and ceramic particles in the thickness of the coating.

Sample 326 has only a single layer coating and was used for comparative grid behaviour tests.

Second Example (Samples 331 and 333)

The metallic powder used was identical to that of the first example, and the grain size was also the same. The ceramic powder was a chromium carbide $Cr_3C_2$ of grain size between 20 and 45 microns (20% by weight of the metallic and ceramic powder mixture). The operational conditions observed in forming the coating were the same as in the preceding example.

Figure 4:
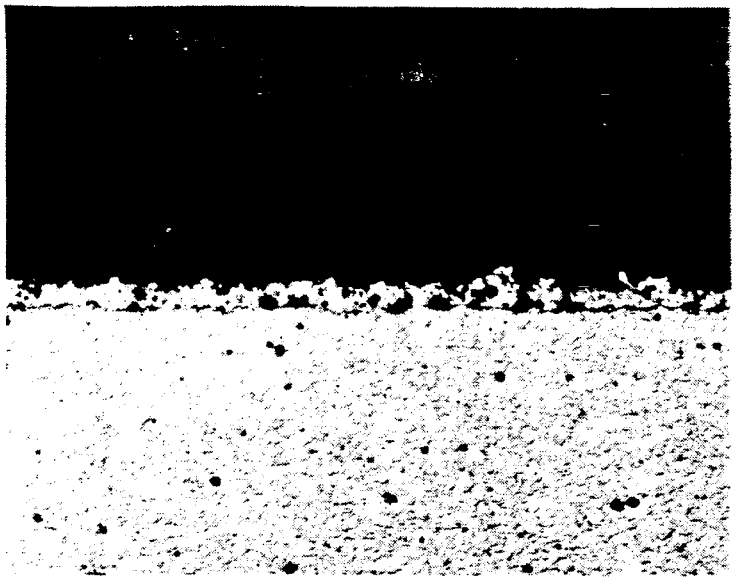
FIGS. 4 to 6 are photomicrographs at magnifications of X100, X500, and X500 similar to those of FIGS. 1 to 3 but showing a second example (Sample 331) of a coating produced in accordance with the invention, the coating comprising Co Ni Cr Al Y Ta of grain size less than 25 microns+20% $Cr_3C_2$ of grain size less than 45 microns.
Figure 5:
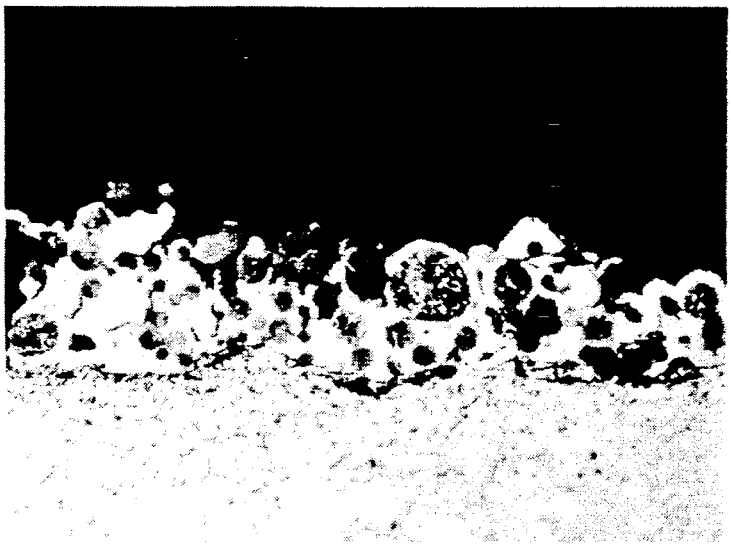
Figure 6:
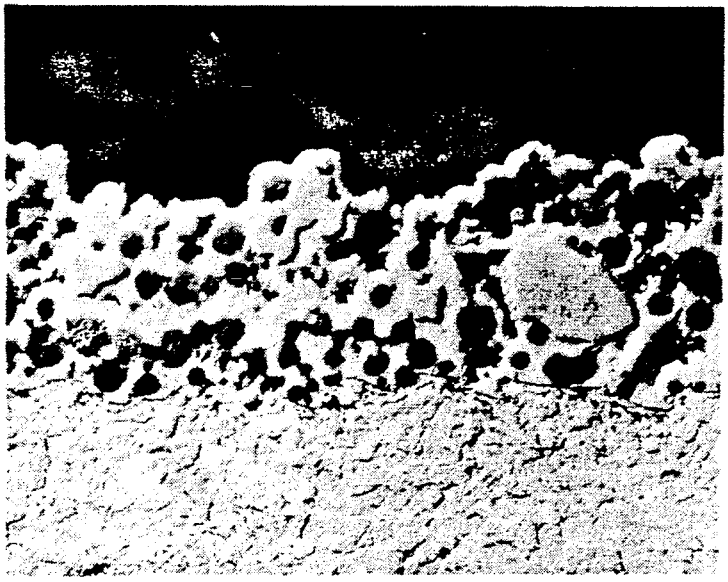

It was found that with two layers (sample 331), one obtains (FIG. 4) a homogeneous coating of a thickness between 40 and 70 microns. The photographs of FIGS. 5 and 6 show that the metal-ceramic alloy/substrate interface is chemically sound, just as in the foregoing example (FIGS. 2 and 3), but exhibits a few pores. There are also a number of pores within the alloy coating itself which are not filled in during the nickeling. The distribution of the particles of M-Cr Al Y and chromium carbide in the metal-ceramic alloy is even and homogeneous.

Sample 333 was formed with a single layer coating for use in comparative grid behaviour tests.

Third Example (Sample 281)

The same Co Ni Cr Al Y Ta metallic powder was used as in the previous examples, with the incorporation into it of 20% by weight of boron nitride BN, the grain size of the latter being between 30 and 60 microns.

Three layers were deposited in succession under the following operational conditions for each layer:

electrophoretic deposition of the metal-ceramic mix as described earlier;

pre-nickeling at 30° C. for 30 mins and 0.1 A/dm$^2$;

two-stage nickeling comprising a first stage for 30 mins at 50° C. and 0.5 A/dm$^2$, and a second stage for 45 mins at 50° C. and 1 A/dm$^2$.

Figure 7:
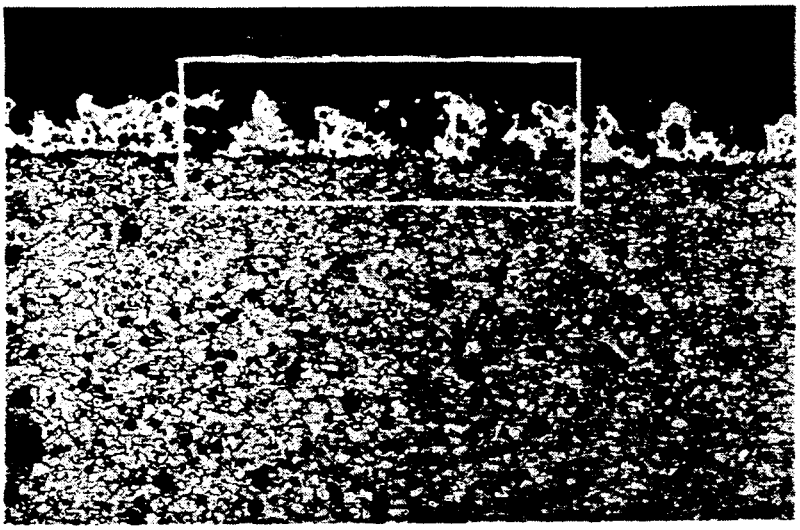
FIGS. 7 to 9 are similar photomicrographs at magnifications of X100, X200, and X500 showing a third example (Sample 281) of a coating produced in accordance with the invention.
Figure 8:
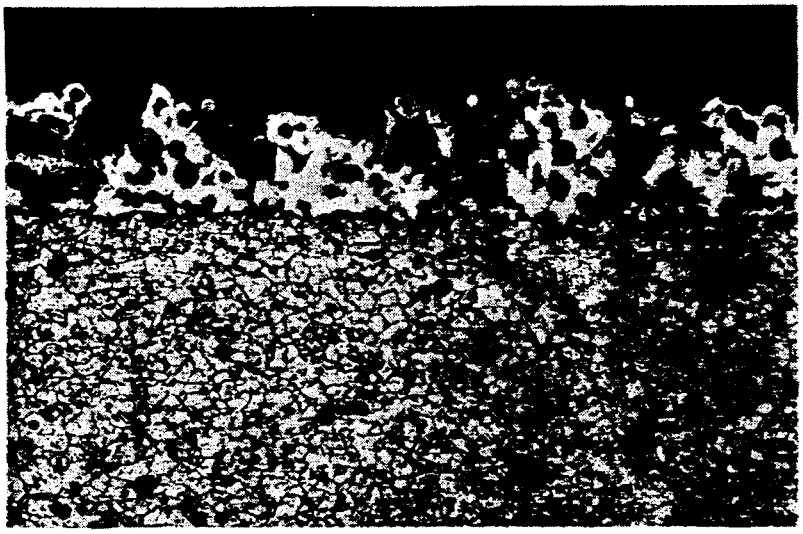
Figure 9:
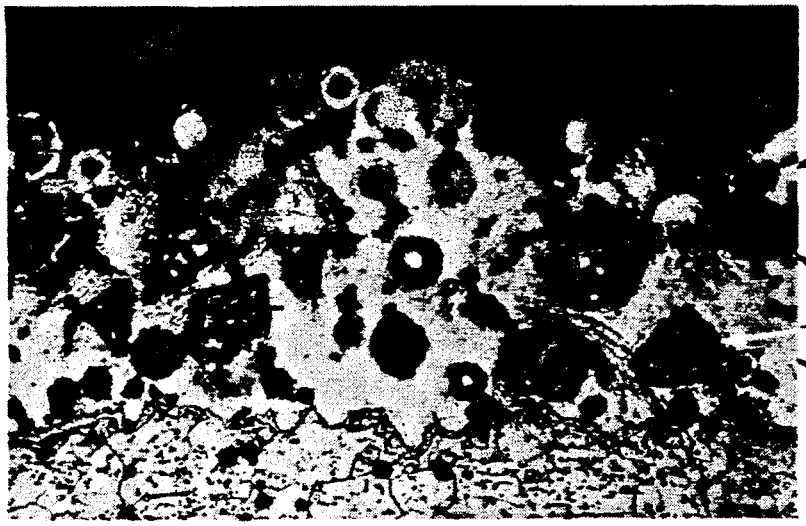

After stress-relieving the coating at 600° C. for 4 hours under vacuum, the coating alloy formed consisted of 49% Co Ni Cr Al Y Ta and BN mixture and 51% electrolytic nickel. The wear-resistant coating (FIG. 7) was of homogeneous thickness ranging between 60 and 70 microns.

The grains of BN, larger than those of the M-Cr Al Y metal, were nevertheless evenly distributed in the coating, and the nickel was diffused homogeneously towards the substrate.

Fourth Example (Sample 285)

The same Co Ni Cr Al Y Ta metallic powder was used as in the previous examples, with the admixture of 20% by weight of titanium diboride $TiB_2$, the grain size of the latter being below 4 microns. Three layers were deposited under operational conditions identical to those used in the third example.

Figure 10:
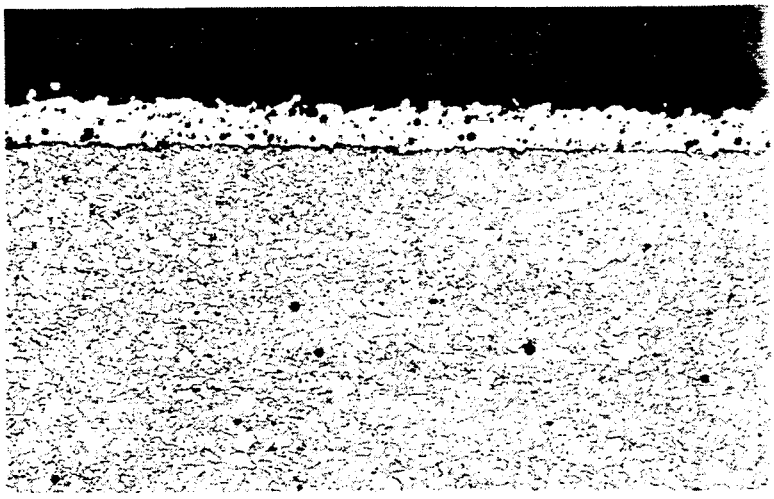
FIGS. 10 to 12 are photomicrographs at magnifications of X100, X500 and X1000 showing a fourth example (Sample 285) of a coating produced in accordance with the invention, the coating comprising Co Ni Cr Al Y Ta of grain size below 25 microns+20% $TiB_2$ of grain size less than 4 microns.
Figure 11:
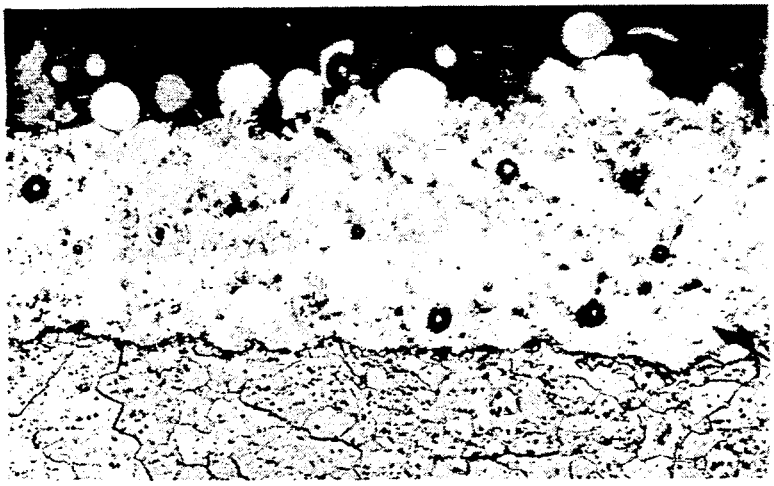
Figure 12:
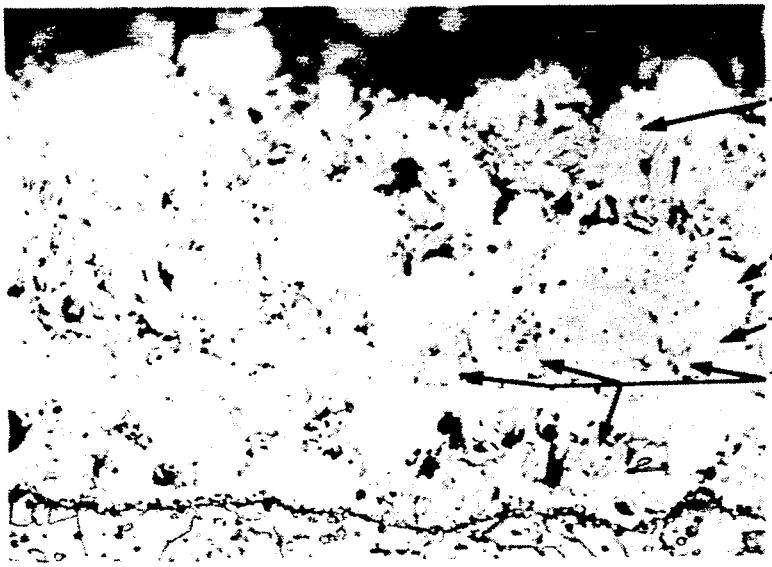

The alloy coating formed comprised a little more than 50% M Cr Al Y Ta and $TiB_2$ and a little less than 50% electrolytic nickel. The thickness of the wear-resistant coating (FIG. 10) is uniform over the entire surface of the sample, close to 54 microns. The titanium diboride particles of very small grain size are particularly well distributed, as are the grains of M-Cr Al Y Ta in the electrolytic nickel medium.

Fifth Example (Sample 469)

The cobalt based superalloy KC25NW (trade name HS31) with a grain size below 25 microns was used as the metallic powder, and was mixed with 20% by weight of alumina $Al_2O_3$ of grain size less than 25 microns. Three successive layers were deposited and stress-relieved to form a coating using the same operational conditions for electrophoretic deposition, pre-nickeling, nickeling and stress-relief as were used in examples 3 and 4.

Figure 13:
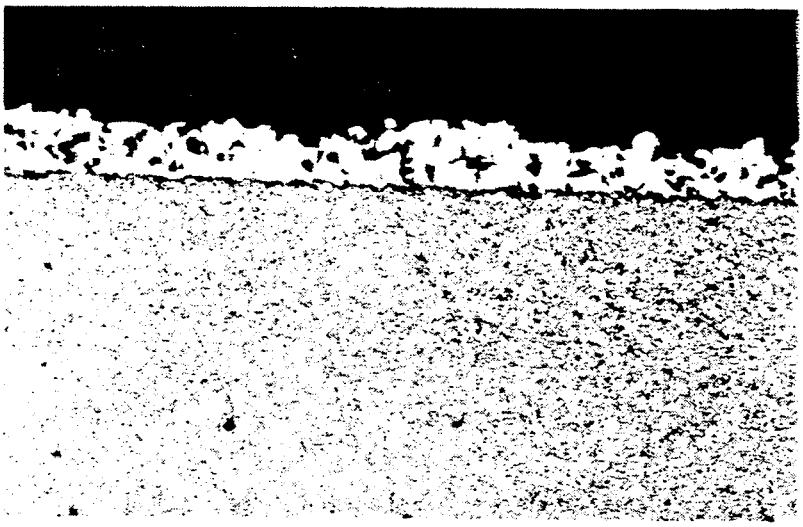
FIGS. 13 to 15 are photomicrographs at magnifications of X100, X500, and X500 showing a fifth example (Sample 469) of a coating produced in accordance with the invention in which the coating comprises KC25NW and 20% $Al_2O_3$, the metal and ceramic powders being of grain size smaller than 25 microns.
Figure 14:
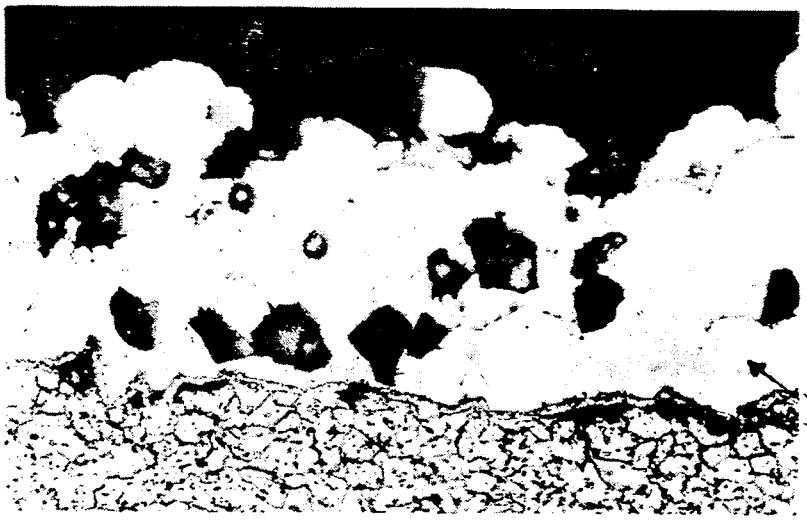
Figure 15:
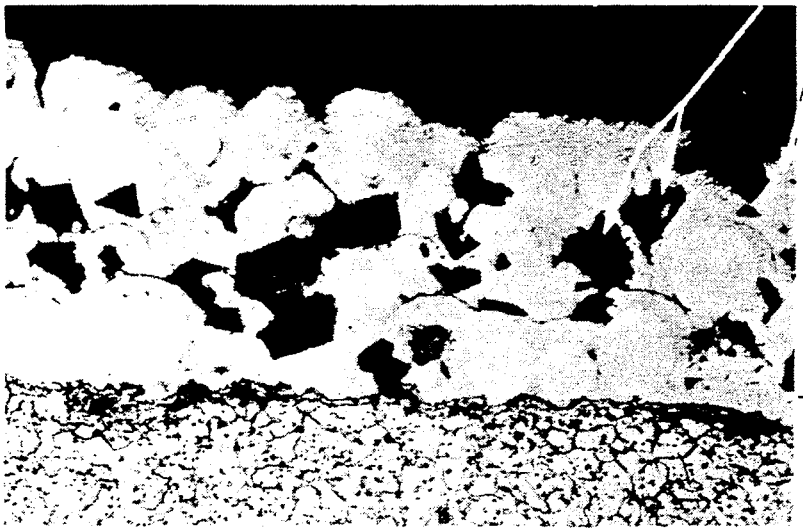

FIGS. 13 to 15 show the evenness of the thickness of the coating between 70 and 80 microns, and the homogeneous distribution of the particles of HS 31 and alumina in the electrolytic nickel.

Sixth Example (Sample 286)

In this example the same M-Cr Al Y metallic powder as used in examples 1 to 4 was mixed with 20% by weight of alumina of grain size below 25 microns.

In this case it was desired to obtain a final coating with a thickness greater than that of the previous examples. To achieve this, rather than depositing more than three layers of the metal-ceramic material, it was decided to form, between the substrate and the metal-ceramic layers, a sub-layer of electrolytic nickel. This sub-layer was obtained after acid pickling of the substrate by deposition of a flash of nickel in a Wood nickeling bath comprising:

| | |
|---|---|
| $NiCl_2$, $6H_2O$: | 240 g/l |
| Nickel metal: | 59 g/l |
| HCl: | from 80 to 110 ml/l at d:1.16. |

Pre-nickeling was carried out at ambient temperature for 6 mins at a current density between 4 and 4.5 A/dm$^2$. The deposition of the nickel flash was followed by an electrolytic deposition of nickel in a sulphamate bath under the same conditions described earlier for the sulphamate nickeling step (c) of the coating process in accordance with the invention.

After this electrolytic nickeling, the metal-ceramic coating process of the invention was performed in conditions identical to those used in examples 3 to 5, i.e. with the deposition of three layers, and the final layer being followed by stress-relief under vacuum for 4 hours at 600° C.

Figure 16:
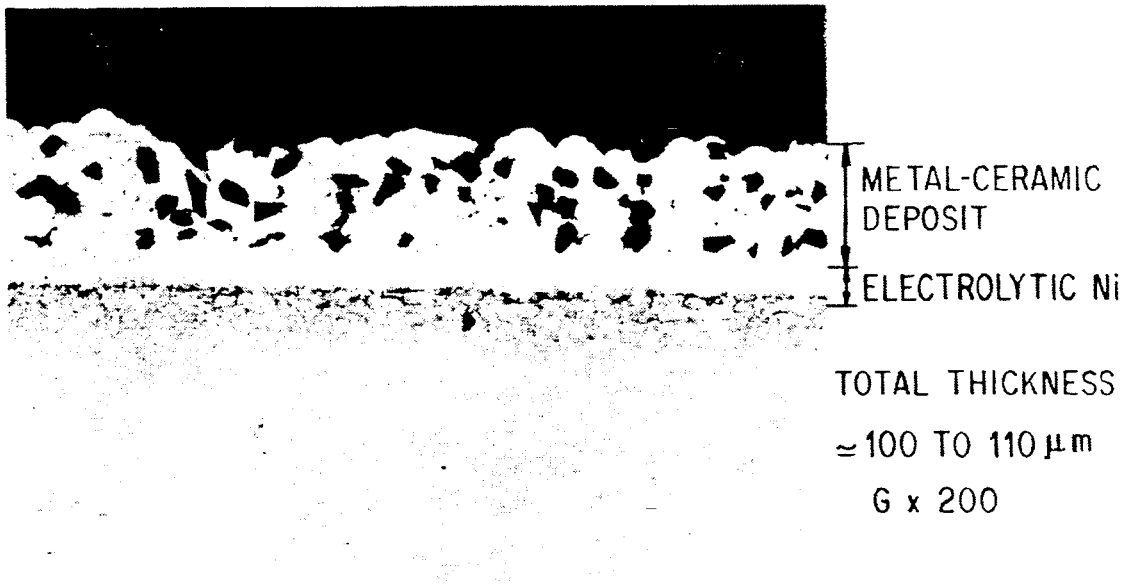
FIGS. 16 and 17 are photomicrographs at magnifications of X200 and X500 showing a sixth example of a coating produced in accordance with the invention and comprising Co Ni Cr Al Y Ta+20% $Al_2O_3$ of grain size less than 25 microns, with a sub-layer of electrolytic nickel.
Figure 17:
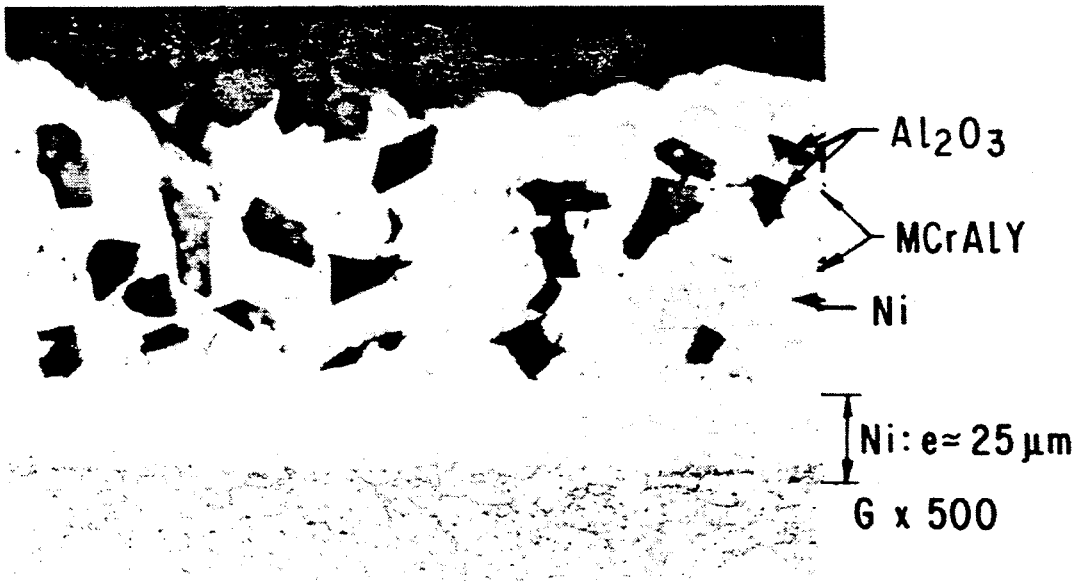
Figure 18:
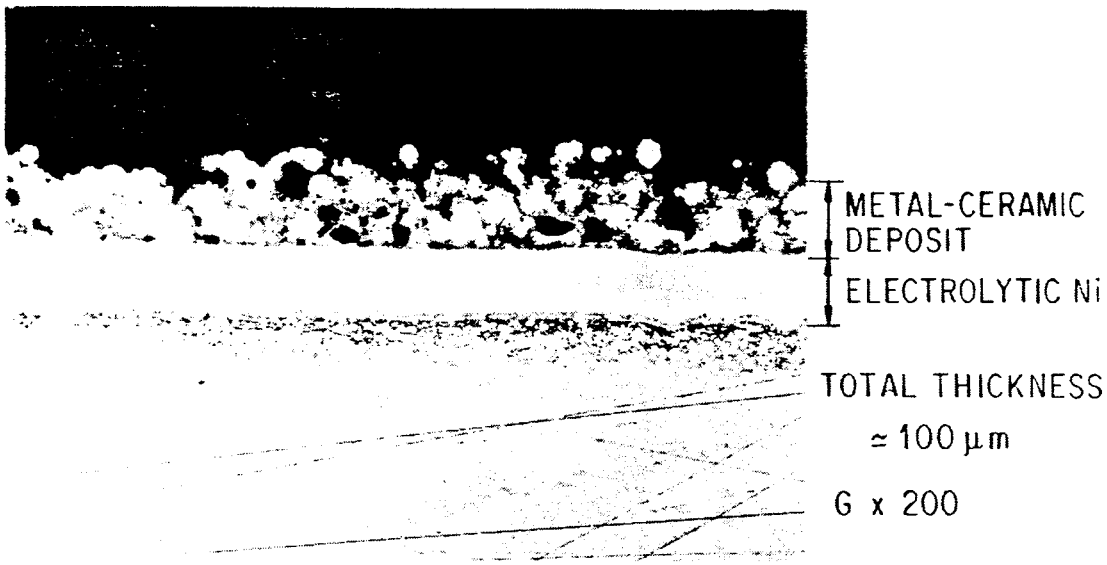
FIGS. 18 and 19 are photomicrographs at magnifications of X200 and X500 showing a seventh example (Sample 328) of a coating produced in accordance with the invention, the coating comprising Co Ni Cr Al Y Ta+30% $Al_2O_3$ with a sub-layer of electrolytic nickel.

The photographs of FIGS. 16 and 17 show the appearance of the coating obtained. The sub-layer of electrolytic nickel has a thickness close to 25 microns, whereas the thickness of the metal-ceramic layers is between 80 and 90 microns. The particles of M-Cr Al Y and the alumina are evenly distributed, and the inter-diffusion of the electrolytic nickel and of the wear-resistant coating has created a particularly efficient keying of the metal-ceramic layers.

Seventh Example (Sample 328)

As in the previous example a sub-layer of electrolytic nickel was formed under the same conditions, increasing the duration of the nickeling so as to obtain a sub-layer about 45 microns thick.

Following this operation a metal-ceramic deposition comprising 70% by weight of the M-Cr Al Y powder and 30% alumina of grain size below 4 microns was carried out, two layers being deposited in the same conditions as in the previous example. The resulting wear-resistant coating had a thickness of from 50 to 60 microns which, together with the thickness of the nickel sub-layer, provided a total coating thickness of between 95 and 105 microns.

Figure 19:
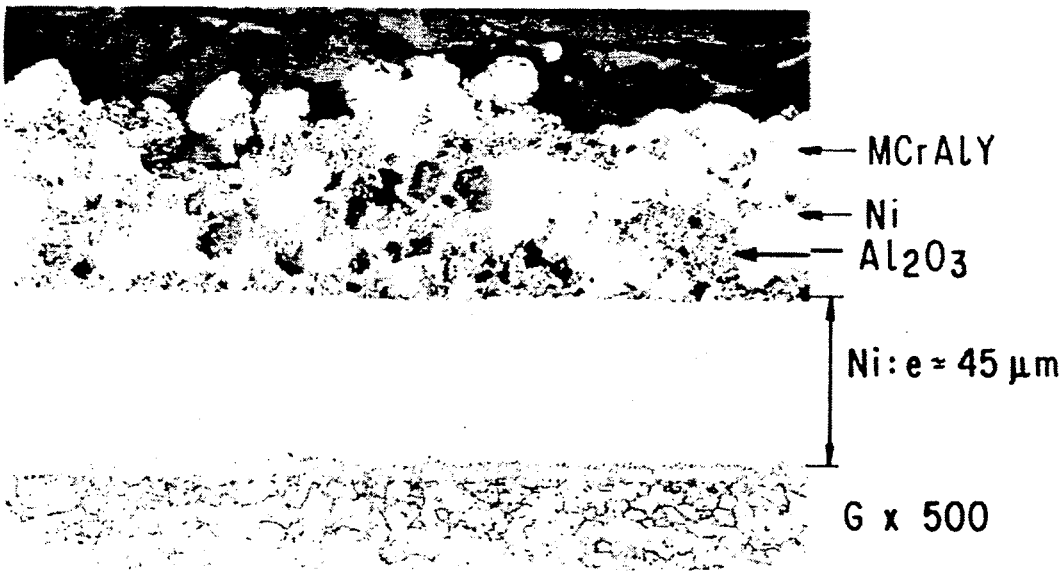

It will be seen from Table 1 and FIG. 19 that the metal-ceramic coating still contains about 50% nickel, although it is distributed in a slightly less homogeneous manner than in the previous examples.

TEST RESULTS

The adherence and wear behaviour of the coatings formed in accordance with the invention were tested, and the results of some of these tests are indicated below.

Bending and Grid Tests

These were carried out on 15×100 mm test pieces to characterize the adherence of the coatings obtained in samples 325,326,331,333.

The results of the bending tests are summarized in Table 2.

TABLE 2

| | TEST SPECIFICATIONS | OBSERVATIONS 326-333 SINGLE LAYER DEPOSIT | RESULTS 325-331 DOUBLE LAYER DEPOSIT |
|---|---|---|---|
| Folding on cylindrical tube of diameter 12.7 mm | Grain size: diameter 10 to 25 microns Theoretical thickness 100 to 150 μm | No cracks. Satisfactory results | No cracks. Good results. |
| Folding on cylindrical tube of diameter 8 mm | Thickness of coating ~50 microns Elongation 11% | No cracks. Satisfactory | No cracks. Good results |

Similar tests were carried out on batches 285,469,286 and 328. The results were of equally good quality, even for batches 286 and 328 having a nickel sub-layer of substantial thickness.

Grid tests were carried out on single layer deposits (samples 326 and 333) and double layer deposits (samples 325 and 331) on samples scored with crossed lines.

Figure 20A:
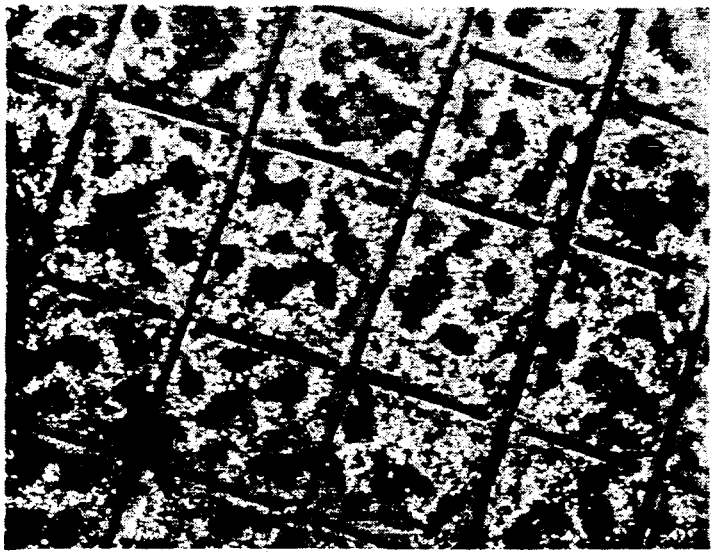
FIGS. 20 to 23 are photomicrographs showing the results of grid tests on various samples, the photographs (a) being at X25 magnification, the photographs (b) being at X200 magnification, and the photographs (c) being at X1000 magnification. The photographs 20*a*,20*b*,20*c* are of sample 326 (example 1, single deposit coating). The photographs 21*a*,21*b*,21*c* are of sample 333 (Example 2, single deposit coating). The photographs 22*a*,22*b*,22*c* are of sample 325 (Example 1, double deposit coating). The photographs 23*a*,23*b*,23*c* are of sample 331 (Example 2, double deposit coating).
Figure 20B:
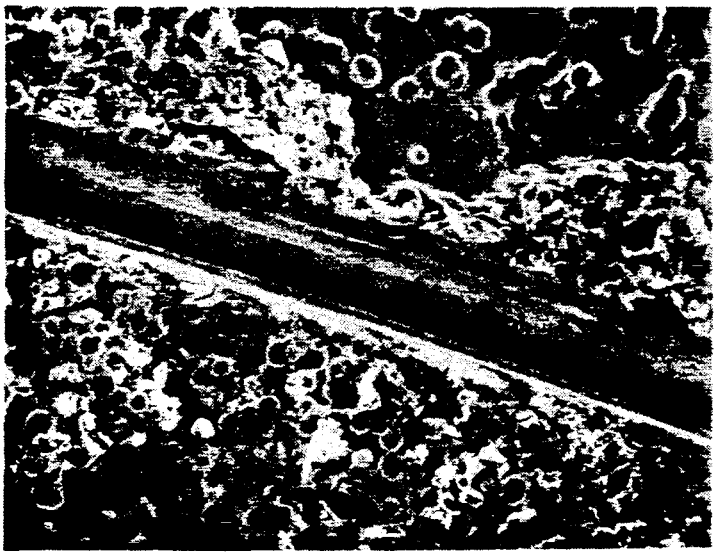
Figure 20C:
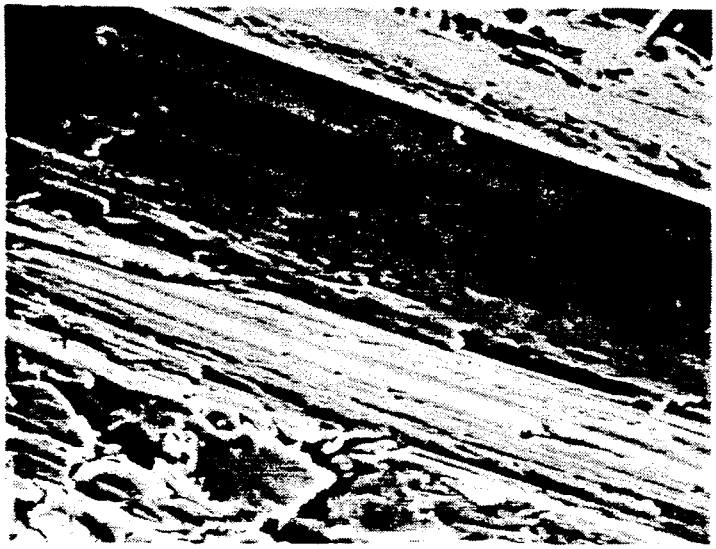
Figure 21A:
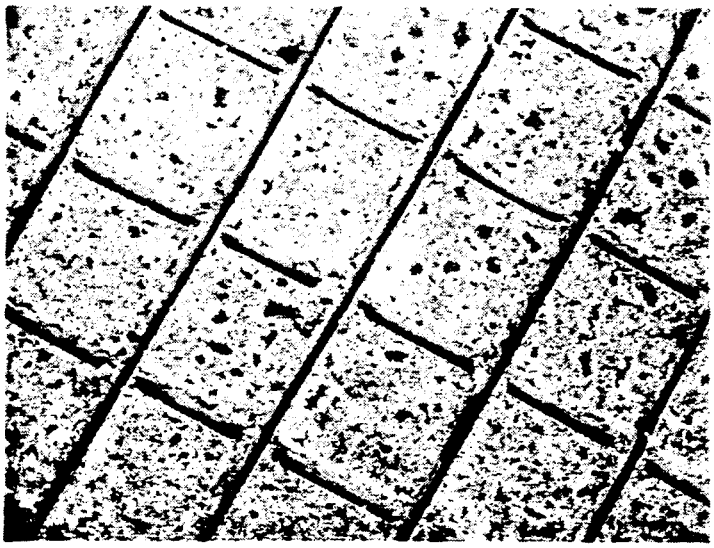
Figure 21B:
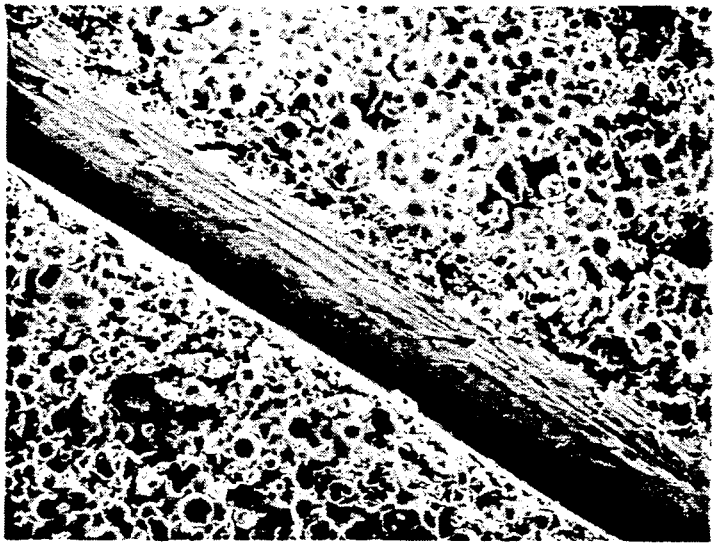
Figure 21C:
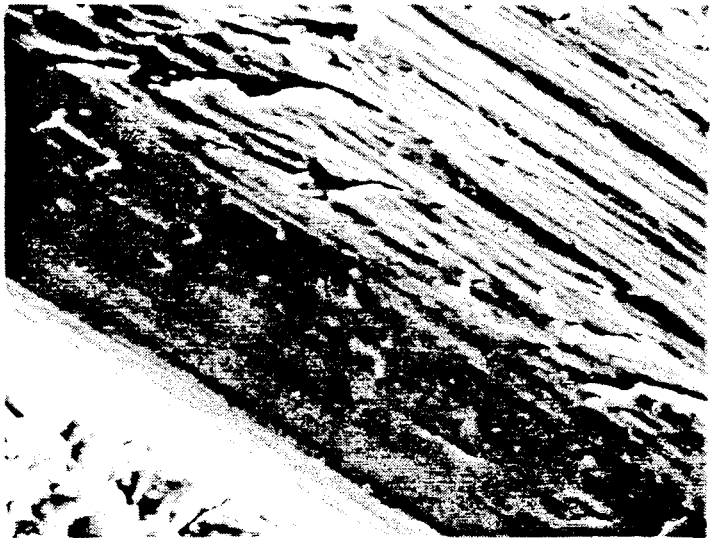

On the single layer coatings (sample 326—FIGS. 20*a*,20*b*,20*c*; sample 333—FIGS. 21*a*,21*b*,21*c*), no breaking away of the protective coating was observed, even though the base metal of the substrate was reached.

Figure 22A:
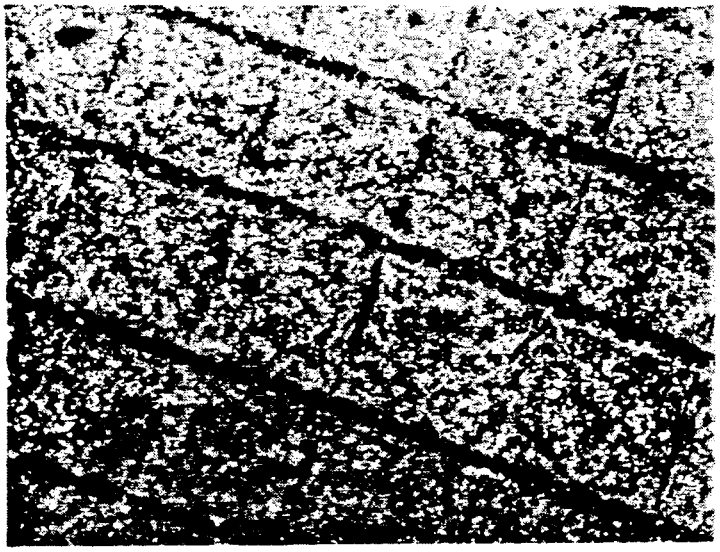
Figure 22B:
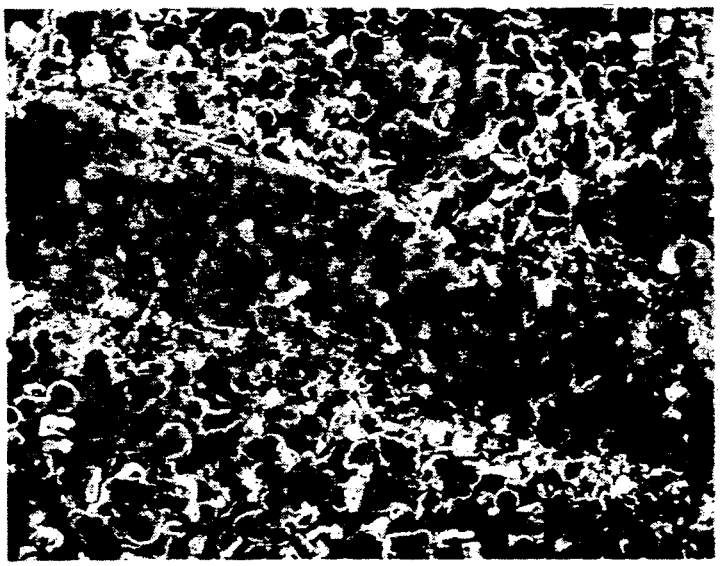
Figure 22C:
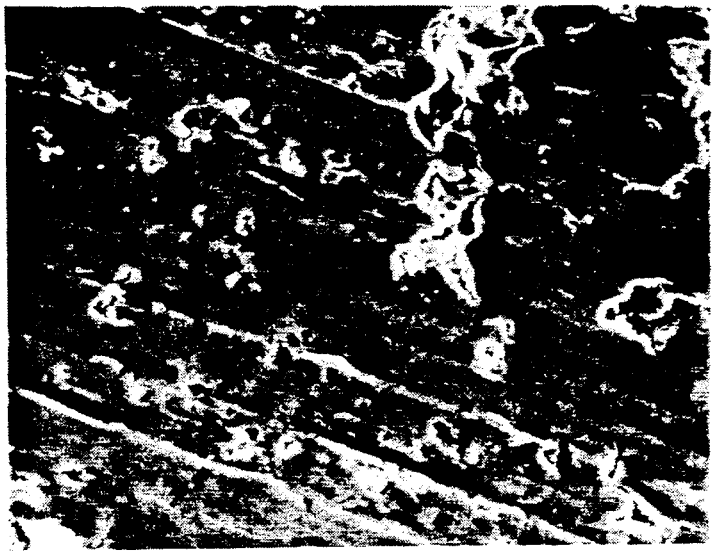
Figure 23A:
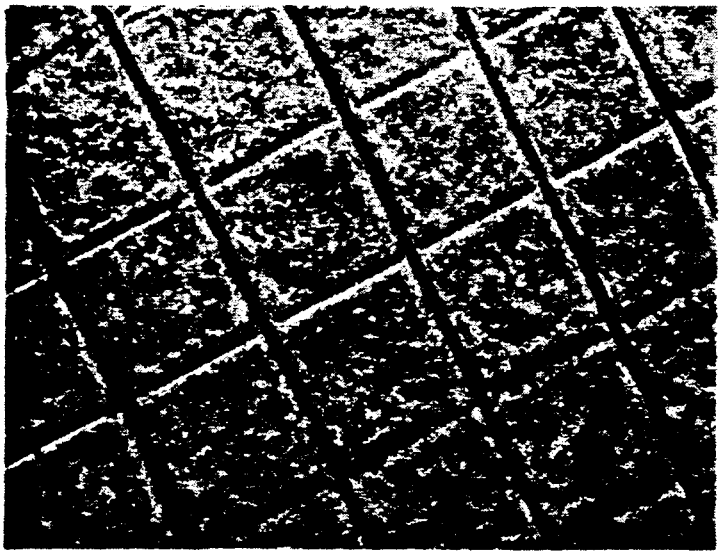
Figure 23B:
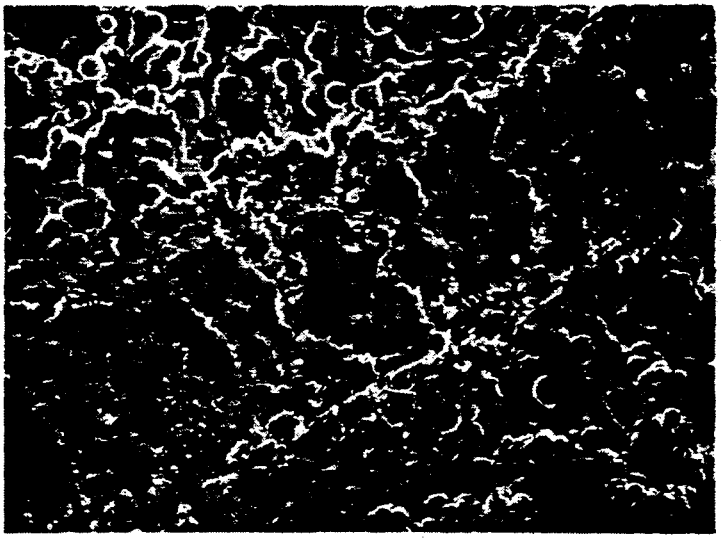
Figure 23C:
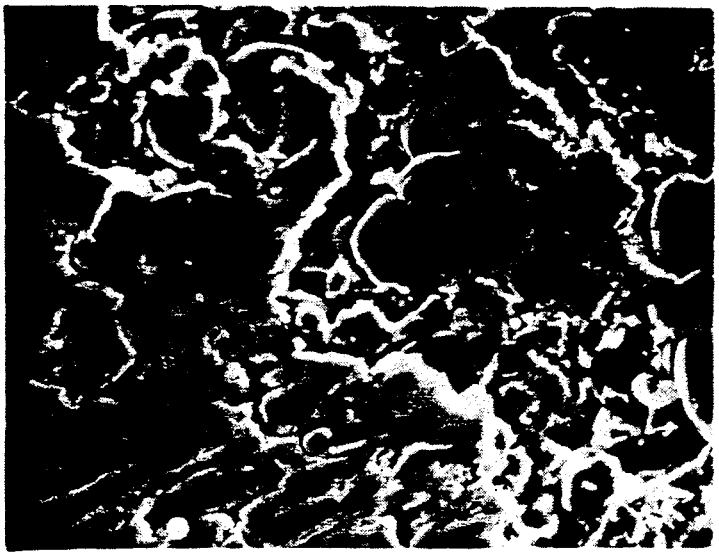

On the double layer coatings (sample 325 FIGS. 22*a*,22*b*,22*c*; sample 331—FIGS. 23*a*,23*b*,23*c*), the results were even better, as only the first layer of the coating was affected by the cross-lining.

These cross-lining tests illustrate the good attachment to the substrate of the coatings produced in accordance with the invention.

Dry Alternating Friction Tests

These were carried out on homogeneous pairs of raw coated test pieces and were conducted in comparison with other known types of wear resistant coating.

Figure 24:
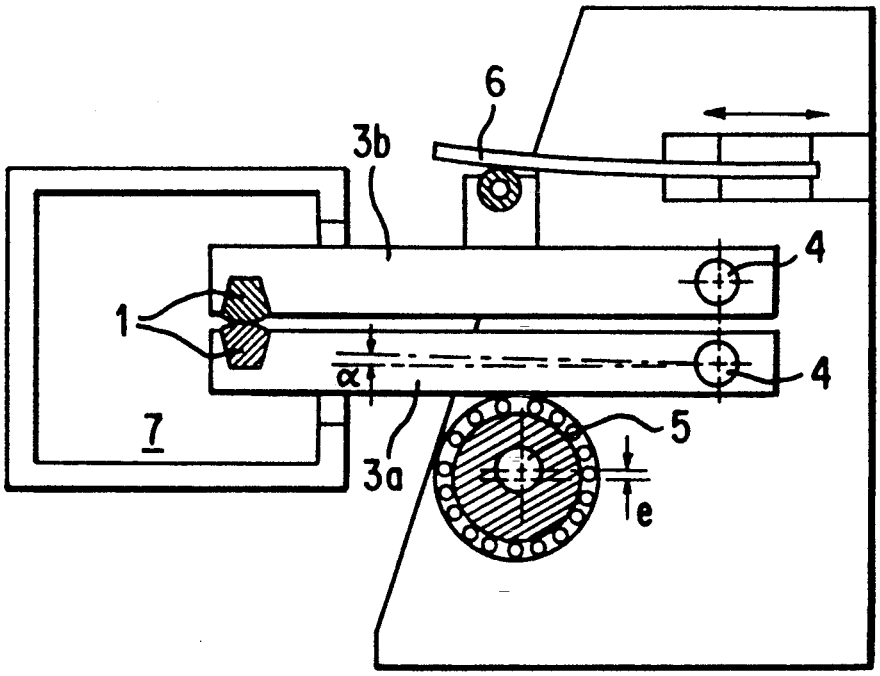
FIG. 24 is a diagram showing the principles of the apparatus used for carrying out dry alternating friction tests on test samples.
Figure 25A:
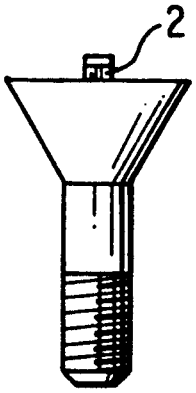
FIGS. 25*a*,25*b* and 25*c* are views showing the shape of the test samples used in the apparatus of FIG. 24.
Figure 25B:
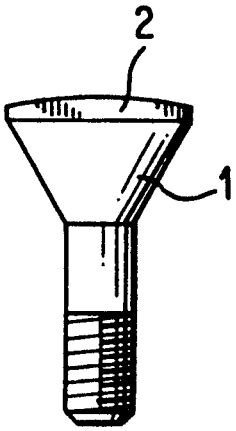
Figure 25C:
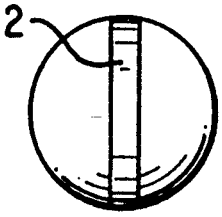

The equipment used is shown in FIG. 24, and the form of the test pieces is shown in FIGS. 25*a*,25*b* and 25*c*.

The test pieces consist of members 1 having a diametrical boss 2 of convex shape on which the wear resistant coating is formed. For the friction tests coatings were used similar to those formed in examples 1 and 2 and corresponding respectively to samples 325 (Ni Co Cr Al Y Ta+20% $Al_2O_3$) and 331 (Ni Co Cr Al Y Ta+20% $Cr_3C_2$).

Two identical test pieces 1 are attached to a pair of arms 3*a* and 3*b* so that the coated bosses 2 are in face to face contact with each other. The two arms 3*a* and 3*b* are pivoted on axles 4, the arm 3*a* being caused to execute an alternating angular movement through an angle $\alpha$ by means of an eccentric 5, while the arm 3*b* is biased against the arm 3*a* by means of a spring blade 6 exerting a load which may vary from 1.7 to 70 daN. The ends of the arms 3*a* and 3*b* holding the test pieces 1 are arranged inside a heated enclosure 7 enabling the friction tests to be conducted over a temperature range of from 20° C. to 600° C. The friction frequency may be set between 0 and 50 Hz and the amplitude of movement may range from 0.1 to 2 mm.

Figure 26:
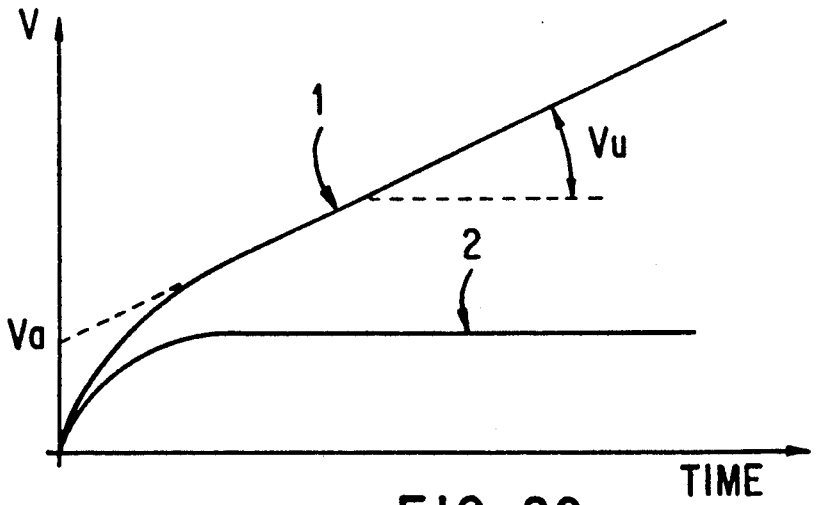
FIG. 26 is a theoretical graph showing the volume worn in terms of time using the friction test apparatus.

In FIG. 26 the curve (1) shows the stabilized wear rate "Vu", whereas the extrapolation (to t=0) of the straight line representing the stabilized wear rate indicates the volume Va worn during the period of wearing-in.

The curve (2) established at Vu=0 is intended to identify the critical wear pressure Pcu which is the ratio of the applied load to the worn surface of the test piece in the event of jammed wear (Vu=0).

Table 3 below is a comparison of the values Ua, Vu and Pcu at 20° C., 250° C., 400° C. and 600 ° C. for homogeneous pairs of test pieces having the following wear resistant coatings:

Test No. 1: Wear-resistant coatings of the invention as in example 1 (sample 325).

Test No. 2: Wear-resistant coatings of the invention as in example 2 (sample 331).

Test No. 3: Wear-resistant coatings of Amdry 996 (trade name) having the composition, by weight:
Al: 6 to 8%
Cr: 23 to 25%
Ni: 8.5 to 11%
Ta: 4 to 6%
Y: 0.4 to 0.8%
Co: the remainder
mixed with 20% by weight of alumina and consolidated at high temperature (1150° C.) for 4 hours as known in the art.

Test No. 4: Wear-resistant coatings formed by plasma deposition of HS31 (trade name) (AFNOR standard KC 25 NW) as known in the art.

Test No. 5: Wear-resistant coatings of Tribomet 104C (trade name) formed by electrolytic deposition of cobalt-chromium carbide as known in the art.

Figure 27:
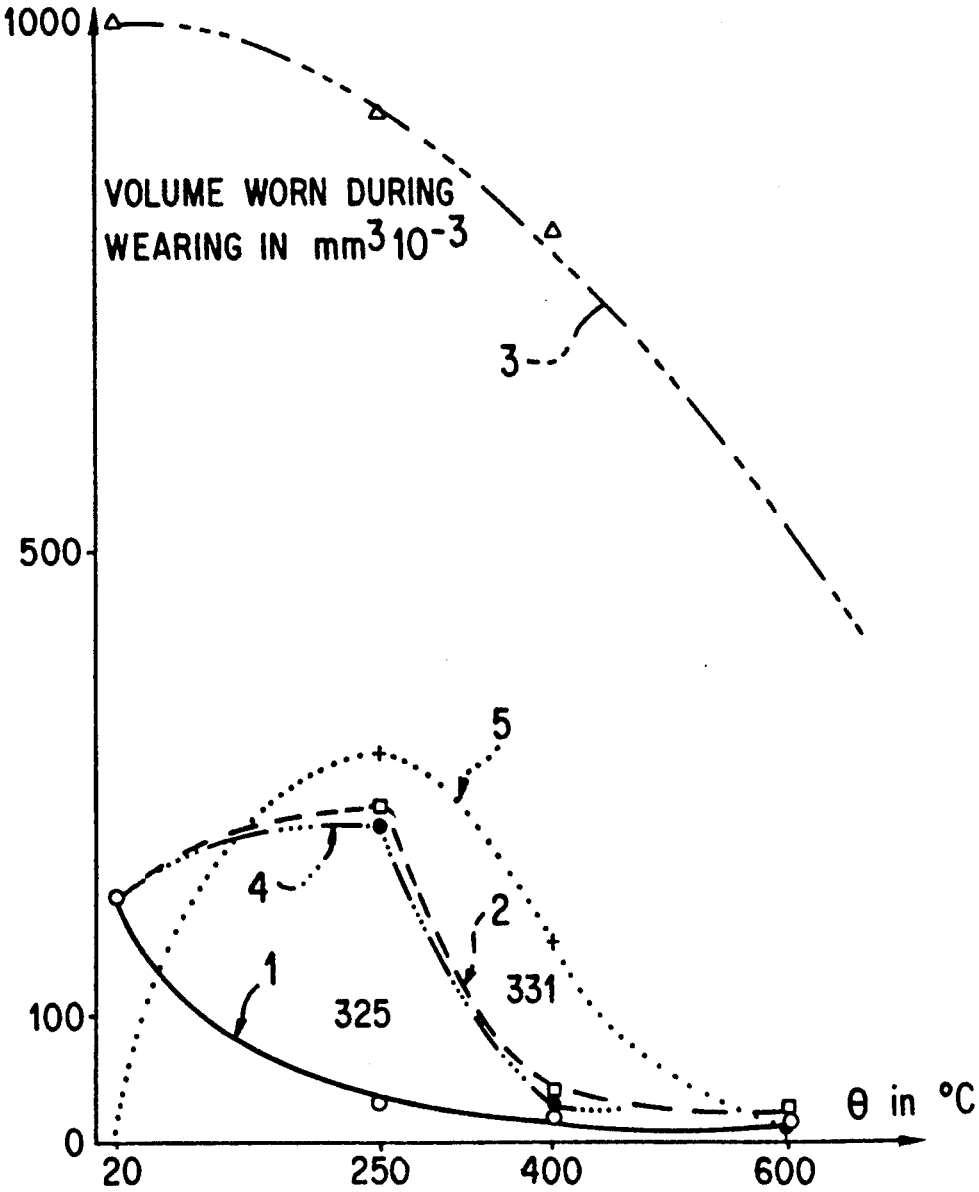

FIG. 27, which is derived from Table 3, shows a comparison of the volumes worn on wearing-in as a function of temperature for the five tests mentioned above. Curves 1 to 5 plot the values of above-mentioned tests 1 to 5.

It will be noted from Table 3 and FIG. 27 that, at ambient temperature, the rate of wear of the coatings formed in accordance with the invention is slightly higher than that of some of the known coatings. However, this behaviour clearly improves as the temperature rises.

Indeed, between 250° C. and 600° C. the coating of the invention containing 20% alumina (sample 325—curve No. 1) exhibits, as a consequence of its low wear on wearing-in and of the relatively high critical pressure, very good wear resistance which is better than, or at least equivalent to, the other coatings tested.

The coating formed in accordance with the invention comprising chromium carbide (sample 331—curve No. 2) exhibits characteristics of much the same quality above 400° C., in which range its wear resistance becomes greater than that of Amdry 996+$Al_2O_3$ (curve No. 3) and of Tribomet 104C (curve 5), and close to that of HS 31 plasma (curve No. 4).

FIG. 27 therefore illustrates the considerable benefit of consolidation by low temperature electrolytic nickeling, the resulting coatings being greatly superior to those of curve 3 formed using the high temperature heat treatment (1150° C./4 hours).

Equivalent results (not described here) have been obtained for coatings containing nitrides or borides (samples 281 and 285), and also for samples 286 and 328 including a sub-layer of electrolytic nickel.

These good results in the hot state make this wear-resistant coating treatment of considerable interest for components of complex shape which must be consolidated at medium temperatures.

Any person skilled in the art will understand that these examples are for guidance only. The marriage of two deposition techniques so different as electrophoresis and electroplating opens up a vast choice of possibilities regarding the nature, the form, and the concentration of the wear-resistant particles, as well as the consolidation treatment (e.g., chromium-plating, cobalt-plating, alloying, etc.).

TABLE 1

| Mixture % by weight | Powder Grain size - diameter (ϕ) microns | Sample No. | OPERATION[1] PL/NS | θ (°C.) | Operating conditions cd (A/dm/time (min.)) | deposit reference | m electrophoresis m total per deposit | Total electrolytic Ni% per deposit | thickness (microns) |
|---|---|---|---|---|---|---|---|---|---|
| Co Ni Cr Al Y Ta + $Al_2O_3$ (20%) | ϕ ≦25 | 325 (2 deposits) | PL (b) | 30° | 0,1/20 | 1st | 9,2/16,8 | 45 | 35 to 50 homogeneous |
| | | | NS (c1) | 30° | | | | | |
| | | 326 (1 deposits) | C NS (c2) | 50° | 1/30 | 2nd | 8,4/17 | 50,5 | |
| Co Ni Cr Al Y Ta + $Cr_3C_2$ 20 (20%) | ϕ MCrALY ≦25 ϕ $CR_3C_2$ ≦25 | 331 (2 deposits) | PL (b) | 30° | 0,1/20 | 1st | 12,5/21,7 | 42 | 60 to 70 homogeneous |
| | | | NS (c1) | 30° | 0,5/30 | | | | |
| | | 233 (1 deposit) | C NS (c2) | 50° | 1/30 | 2nd | 12,1/22,1 | 45 | |
| Co Ni Cr Al Y Ta + 20% BN | ϕ MCrCALY ≦25 30 ≦ϕ BN ≦60 | 281 | PL (b) | 30° | 0,1/30 | 1st | 12,2/21,6 | 44 | 60 to 70 microns |
| | | | NS (c) | 50° | 0,5/30 | 2nd | 10,2/20,8 | 51 | |
| | | | | | 1/45 | 3rd | 11,3/22,9 | 51 | |
| Co Ni Cr Al Y Ta + 20% $TiB_2$ | ϕ MrCALY ≦25 ϕ TiB ≦4μ | 285 | PL (b) | 30° | 0,1/30 | 1st | 6,4/18,3 | 65 | 60 to 70 microns |
| | | | NS (c) | 50° | 0,5/30 | 2nd | 11,6/22,4 | 48 | |
| | | | | | 1/45 | 3rd | 15,4/26,9 | 43 | |
| KC 25 NW (H 531) 20% $Al_2O_3$ | ϕ KC25 NW ≦25 ϕ AL 0 25 | 469 | PL (b) | 30° | 0,1/30 | 1st | 8,1/21,2 | 62 | 70 to 80 microns |
| | | | | 50° | 0,5/30 | 2nd | 10,4/25 | 58 | |
| | | | | | 1/45 | 3rd | 8,7/26,3 | 67 | |
| Co Ni Cr Al Y Ta + 20% $Al_2O_3$ | ϕ ≦25 | 286 | PL (b) | 30° | 0,1/30 | 1st | 7,3/17 | 57 | 80 to 90 microns |
| | | | NS (c) | 50° | 0,5/30 | 2nd | 9/19,2 | 53 | |
| | | | | | 1/45 | 3rd | 8,6/25,4/ | 66 | |
| Co Ni Cr Al Y Ta + 30% $Al_2O_3$ | ϕ MCrALY ≦25 ϕ $Al_2O_3$ ≦4 | 328 | PL (b) | 30° | 0,1/30 | 1st | 8,7/17,2 | 49 | 50 to 60 microns |
| | | | NS (c) | 50° | 0,5/30 | 2nd | 8,6/18,2 | 53 | |
| | | | | | 1/45 | | | | |

[1]Step (a): Electrophoresis operational conditions identical in all cases: U = 500 V; t = 5s
Step (b): PL = Prenickeling in a neutral ammonium lactate bath 6.8 pH 7

TABLE 3

| | Deposits Examined | Test Temperatures 20° C. Va | Vu | PCU | 250° C. Va | Vu | PCU | 400° C. Va | Vu | PCU | 600° C. Va | Vu | PCU |
|---|---|---|---|---|---|---|---|---|---|---|---|---|---|
| 1 | Co Ni Cr Al Y Ta + 20% | 200 | 5450 | | 26 | | 13,1 | 15 | | 18 | 10 | | 36 |
| | Al O Ex 325 | 200 | 5450 | | 26 | | 13,1 | 15 | | 18 | 10 | | 36 |
| 2 | Co Ni Cr Al Y Ta + 20% | 200 | 4600 | | 280 | 1030 | | 33 | | 11,5 | 21 | | 15, |
| | Cr C Ex 331 | 200 | 4600 | | 280 | 1030 | | 33 | | 11,5 | 21 | | 15, |
| 3 | Amdry 996 + 20% | 1000 | 150 | | | 125 | | 800 | | 2,95 | | | |
| | Al O thermally consolidated at 1150° C. for 1 hour | 1000 | 150 | | | 125 | | 800 | | 2,95 | | | |
| 4 | HS 31 plasma | 200 | 220 | | 270 | 125 | | 30 | | 15 | | | |
| | | 200 | 220 | | 270 | 125 | | 30 | | 15 | | | |
| 5 | T 104 C | 0 | 250 | | 330 | | 4 | 170 | | 5,7 | 7 | | 23 |

TABLE 3-continued

| Deposits Examined | Test Temperatures | | | | | | | | | | | |
|---|---|---|---|---|---|---|---|---|---|---|---|---|
| | 20° C. | | | 250° C. | | | 400° C. | | | 600° C. | | |
| | Va | Vu | PCU | Va | Vu | PCU | Va | Vu | PCU | Va | Vu | PCU |
| | 0 | 250 | | 330 | | 4 | 170 | | 5,7 | 7 | | 23 |

Va: Volume worn during wearing-in ($10^{-3}$ $mm^3$)
Vu: Stabilized rate of wear ($10^{-3}$ $mm^3/h$)
PCU: Critical wear pressure (MPa)

We claim:

1. A process for forming a protective coating on an engine component of steel or superalloy for providing resistance against wear from alternating friction at temperatures in the range of 400° C. to 800° C., said process comprising the steps of:

a) forming a deposit on said component by electrophoresis, said deposit having a metal-ceramic structure comprising a mixture of from 85% to 50% by mass of metallic powder and from 15% to 50% by mass of ceramic powder, in which said metallic powder is a cobalt-based superalloy comprising 24–26 wt. % Cr, 10–12 wt. % Ni, 7–9 wt. % W and the remainder Co or is of M Cr Al Y wherein M represents at least one metal selected from the group consisting of Ni, Co and Fe and wherein said M Cr Al Y powder may additionally contain Ta, and said ceramic powder is selected from the group consisting of oxides, carbides, nitrides, and borides;

b) subjecting said deposit to electrolytic pre-nickeling in an electrolysis bath at a pH between 6 and 8; and c) after said prenickeling step, subjecting said deposit to electrolytic nickeling in an acid sulphamate bath.

2. A process according to claim 1, wherein said ceramic powder is selected from the group consisting of $Al_2O_3$, $Cr_2O_3$, SiC, $Cr_3C_2$, BN, TiN and $TiB_2$.

3. A process according to claim 1, wherein said electrophoretic deposition step a) uses a mixture of metallic and ceramic powders wherein said metallic powder has the following composition, by weight:

Cr: 23 to 25%
Ni: 8.5 to 11%
Al: 6 to 8%
Ta: 4 to 6%
Y: 0.4 to 8%
Co: the remainder and said ceramic powder is $Cr_3C_2$, $Al_2O_3$, BN or $TiB_2$, and said mixture of metallic and ceramic powders is deposited in step a) from a bath containing a mixture of isopropanol and nitromethane, a soluble metallic or organo-metallic salt as electrolyte in an amount less than 0.1 g/l, and from 40 to 100 g/l of said mixture of metallic and ceramic powders, while magnetically stirring said bath and using an electric field of from 100 to 500 V/cm for a period not more than 60 seconds.

4. A process according to claim 1, wherein said electrophoretic deposition step a) has a duration between 5 and 60 seconds and produces a deposit of a thickness less than 40 microns.

5. A process according to claim 1, wherein said electrolytic pre-nickeling step b) is carried out in an electrolysis bath containing:

$NiSO_4$: 70 g/l
$H_3BO_3$: 15 g/l
$NH_4Cl$: 15 g/l
Ammonium lactate: 10 g/l (8.5 ml/l)

said bath having a pH maintained at a value between 6.8 and 7 by the addition of NaOH, and being operated, without stirring, at a current density between 0.1 and 0.5 $A/dm^2$ and a temperature between 20° C. and 35° C. for from 10 to 30 minutes.

6. A process according to claim 1, wherein said nickeling step c) is carried out in an acid bath containing nickel sulphamate and having a pH of about 4, at a temperature between 20° C. and 50° C. and a current density between 0.5 and 1 $A/dm^2$ for a period of from 10 to 60 minutes.

7. A process according to claim 1, wherein said nickeling step c) is carried out in two successive stages in the same bath, said first stage c1) being conducted at a temperature of from 25° C. to 55° C. and a current density of 0.5 $A/dm^2$ for about 30 minutes, and said second stage c2) being conducted at a temperature of from 45° C. to 55° C. and a current density of 1 $A/dm^2$ for a period of from 30 to 60 minutes.

8. A process according to claim 1, including a further step d) of stress-relieving said nickel in said deposit at about 600° C. for 4 hours under vacuum.

9. A process according to claim 1, wherein said sequence of steps a) b) and c) is repeated until a coating of the desired thickness is obtained from a number of relatively thin deposits formed one on top of another, and said process includes a final stress-relieving step performed under vacuum at 600° C.

10. A process according to claim 1, wherein prior to said electrophoretic deposition step a), said component is subjected to a preliminary pre-nickeling step for from 5 to 6 minutes at a current density between 4 and 5 $A/dm^2$ followed by a nickeling step for from 20 to 40 minutes in a sulphamate bath at a current density between 3 and 5 $A/dm^2$.

11. A process according to claim 10, wherein said sequence of steps a), b) and c) is repeated until a coating of the desired thickness has been obtained, and said process includes a final stress-relieving step performed under vacuum at 600° C. for 4 hours.

* * * * *

UNITED STATES PATENT AND TRADEMARK OFFICE

CERTIFICATE OF CORRECTION

PATENT NO. : 5,078,837

DATED : January 7, 1992

INVENTOR(S) : Martine Descamp et al

It is certified that error appears in the above-indentified patent and that said Letters Patent is hereby corrected as shown below:

On title page, item

[75] delete Inventors in its entirety and insert --Martine Descamp, Villejuif; Yves C.L.A. Honnorat, Orsay; Michel M. Ruimi, Paris, all of France--

[57] Abstract, line 7, delete "59%", insert --50%--.

Column 2, line 44, delete "prenickeling", insert --pre-nickeling--.

Column 3, line 2, delete "wear resistance", insert --wear-resistance--;
line 16, delete "prenickeling", insert --pre-nickeling--;
line 18, delete "prenickeling", insert --pre-nickeling--;
line 25, delete "prenickeling", insert --pre-nickeling--.

Column 5, line 64, delete "gain", insert --grain--.

Column 7, line 55, delete "cobalt based", insert --cobalt-based--.

UNITED STATES PATENT AND TRADEMARK OFFICE

CERTIFICATE OF CORRECTION

PATENT NO. : 5,078,837

DATED : January 7, 1992

INVENTOR(S) : Martine Descamp et al

It is certified that error appears in the above-indentified patent and that said Letters Patent is hereby corrected as shown below:

Column 9, line 46, delete "wear resistant", insert --wear-resistant--;
line 51, delete "wear resistant", insert --wear-resistant--.

Column 10, line 27, delete "(Vu=0)", insert --(Va=0)--;
line 30, delete "wear resistant", insert --wear-resistant--.

Column 11, Table I at bottom of Table, delete "Prenickeling", insert --Pre-nickeling--.

Column 11, Table, 3, left-hand column of the Table, change "Al O" to --$Al_2O_3$-- both occurrences; and change "Cr C" to --$Cr_3C_2$--.

Column 13, Claim 1, line 35, delete "prenickeling", insert --pre-nickeling--.

Signed and Sealed this

Twenty-fourth Day of August, 1993

Bruce Lehman

*Attest:*

BRUCE LEHMAN

*Attesting Officer*

*Commissioner of Patents and Trademarks*